United States Patent [19]

Hansen et al.

[11] Patent Number: 4,488,136

[45] Date of Patent: Dec. 11, 1984

[54] COMBINATION TRANSFORMER WITH COMMON CORE PORTIONS

[75] Inventors: Irvin L. Hansen; Randall W. Haack, both of Muncie, Ind.

[73] Assignee: Westinghouse Electric Corp., Pittsburgh, Pa.

[21] Appl. No.: 526,205

[22] Filed: Aug. 23, 1983

Related U.S. Application Data

[63] Continuation of Ser. No. 264,778, May 18, 1981, abandoned.

[51] Int. Cl.[3] ..... H01F 27/24

[52] U.S. Cl. ..... 336/215; 336/10; 336/60; 336/180

[58] Field of Search ..... 336/5, 10, 60, 180, 336/215

[56] References Cited

U.S. PATENT DOCUMENTS 2,779,926 1/1957 Johnson et al. ..... 336/5

2,864,993 12/1958 Schober ..... 336/215 X 4,013,985 3/1977 Graham et al. ..... 336/5

FOREIGN PATENT DOCUMENTS 752313 1/1966 Canada ..... 336/5

907338 10/1962 United Kingdom .

OTHER PUBLICATIONS

Patent Abstracts of Japan, vol. 5, No. 205, Dec. 25, 1981, p. 877E88.

*Primary Examiner*—A. D. Pellinen

*Assistant Examiner*—S. Steward

*Attorney, Agent, or Firm*—D. R. Lackey

[57] ABSTRACT

A combination transformer with common yoke core characterized by the combination of a main transformer and series transformers, which transformers have separate and complete core and coil assemblies with a common core leg or yoke to reduce the core size, weight and loss.

4 Claims, 7 Drawing Figures

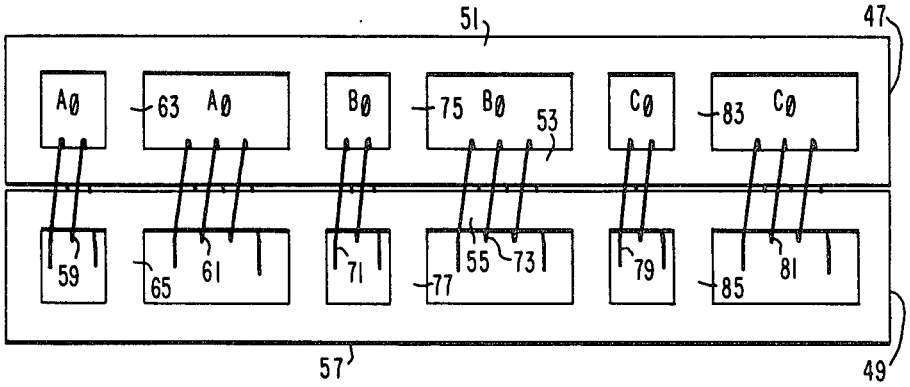
FIG. 5
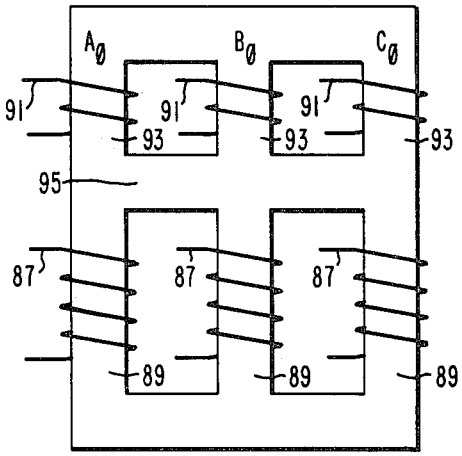
FIG. 6
FIG. 1A
PRIOR ART
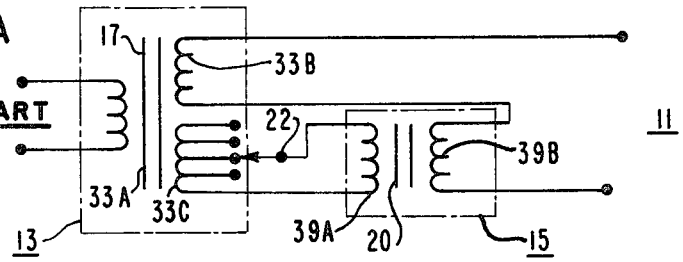

COMBINATION TRANSFORMER WITH COMMON CORE PORTIONS

This application is a continuation of application Ser. No. 264,778 filed May, 18,1981, now abandoned.

BACKGROUND OF THE INVENTION

1. Field of the Invention

This invention relates to a transformer structure comprised of complete core and coil assemblies for a main transformer and a series transformer with a portion of the core of each transformer being common to both transformers.

2. Description of the Prior Art

Certain transformer applications require the combination of a main transformer plus a series transformer to achieve the desired electrical parameters. When this concept is employed, the main and series transformer normally consist of two separate and complete core and coil assemblies. A complete unit is quite large, heavy, and expensive.

As the voltage of the transformers increases, the size of the series transformers increases correspondingly. In furnace transformer applications, for example, the series transformer may have approximately 50% of the KVA parts of the main transformer. Consequently, it is desirable to utilize space as effectively as possible.

SUMMARY OF THE INVENTION

It has been found in accordance with this invention that problems incurred in the design and use of separate and complete core and coil assemblies for main and series transformers may be overcome by providing electrical inductive apparatus comprising a first magnetic core structure having n first leg portions and first and second yoke portions formed of stacked metallic laminations, the n leg portions being spaced apart to form n-1 first apertures therebetween; a second magnetic core structure having n second leg portions and third and fourth yoke portions formed of stacked metallic laminations, the n second leg portions being space apart to form n-1 second apertures therebetween; a winding structure inductively coupled to each magnetic core structure; and at least a portion of one yoke of the first magnetic core structure being in common with at least a portion of the second magnetic core structure.

The advantage of the apparatus of this invention is that it utilizes a common core leg or yoke to reduce the core's size, weight, and core loss.

BRIEF DESCRIPTION OF THE DRAWINGS

FIG. 1A is a schematic diagram of the prior art main and series transformers shown in FIG. 1;

FIG. 5 is a plan view of a shell form transformer in accordance with this invention; and FIG. 6 is a plan view of a core form transformer in accordance with this invention.

DESCRIPTION OF THE PREFERRED EMBODIMENTS

Figure 1:
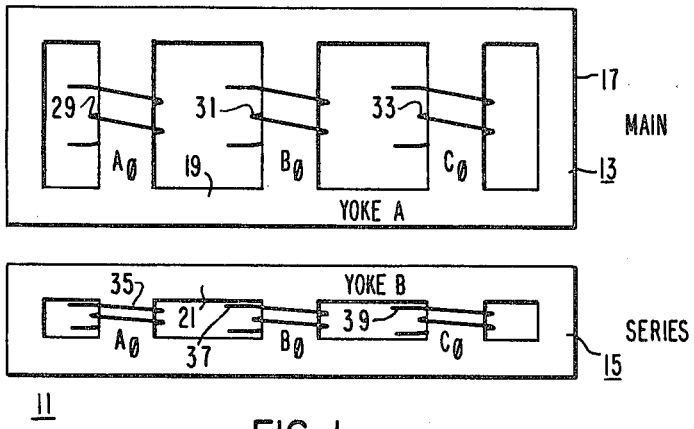
FIG. 1 PRIOR ART
FIG. 1 is a plan view of a shell form transformer with separate core-coil assemblies for main and series transformer subsections of prior art construction.

In FIG. 1, a transformer arrangement of prior art construction is generally indicated at 11 and it comprises a main core-coil assembly 13 and an auxiliary or series core-coil assembly 15. The main assembly 13 includes a core 17 having a yoke 19 and coils 29, 31 and 33. Similarly, the auxiliary assembly 15 includes a core 20 having a yoke 21 which is separate from the yoke 19 in accordance with the prior art.

FIG. 1A illustrates the electrical phase of transformer arrangement 11 which includes coil 33 of the main transformer 13 and coil 39 of the series tansformer 15. The remaining two electrical phases would have a similar configuration. Coil 33 of the main transformer 13 includes a primary winding 33A, a secondary winding 33B and a tapped regulating winding 33C, all disposed in inductive relation with the main core 17. Coil 39 of the series transformer 15 includes a primary winding 39A and a secondary winding 39B disposed in inductive relation with the series core 20. Winding 39A is connected to the tapped regulating lating winding 33C via a suitable tap changer 22, and secondary winding 39B is connected in series with secondary winding 33B.

Figure 2:
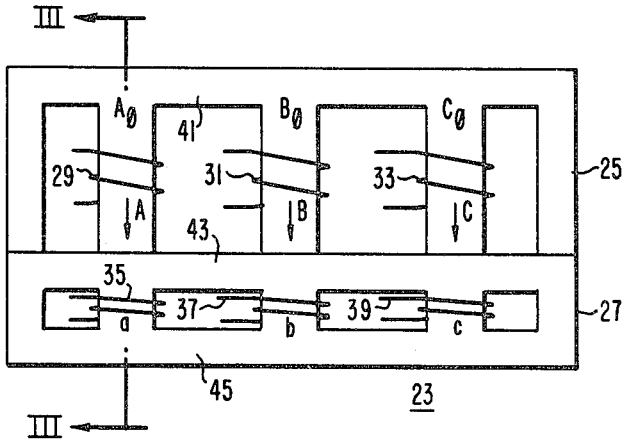
FIG. 2 is a plan view of a shell form transformer having a common yoke for main and series core-coil assemblies in accordance with this invention.

In FIG. 2, a transformer generally indicated at 23 includes cores 25, 27 which are so-called "5-leg" core-coil assemblies including coils 29, 31, 33 for the main core 25 and coils 35, 37, 39 for the series core 27. The transformer 23 also comprises core yokes 41, 43, 45 of which the yoke 43 is common to both cores 25, 27.

The commonality of the yoke 43 to both cores 25, 27 is the substance of this invention.

Figure 3:
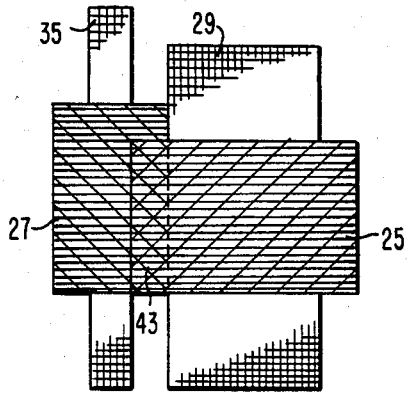
FIG. 3 and 4 are vertical sectional views taken on the line III—III of FIG. 2 showing two embodiments of combined core assemblies in which one of the main and series transformer cores is larger than the other.
Figure 4:
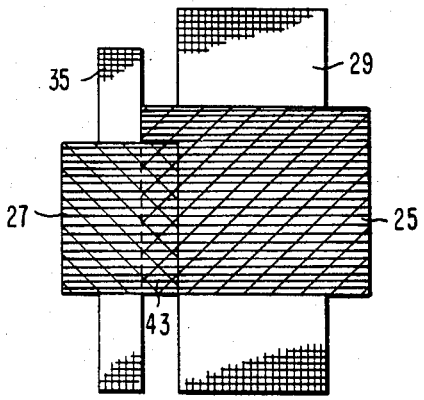

In FIG. 3, yoke 43 is shown as being in overlapping portions of the cores 25, 27. Similarly, in FIG. 4, the yoke 43 is shown as being common to the cores 25, 27. The main and series cores 25, 27 are not necessarily the same height nor do they necessarily operate at the same induction.

Thus, the two separate shell form core and coil assemblies of the prior art construction (FIG. 1) is replaced by a core and coil assembly construction of FIG. 2 by combining separate yokes 19, 21 (FIG. 1) into a common yoke 43 (FIG. 2), thereby effectually replacing two yokes with one yoke. In operation, the flux density is constant in paths A, B, and C because the flux is generated by the windings of the main core 25; that is, a constant volts/turn. However, the flux density in the series core 27 is not constant because the applied voltage varies with the tap position on the main core 25 regulating winding. When the series transformer is not excited, flux will not flow in paths a, b, and c; for which reason the flux flowing in paths A, B, and C will flow through the common yoke 43. As the boost excitation on the series transformer increased, the flux begins to flow in paths a, b, and c. Therefore, the flux in the common yoke will begin to flow through a, b, and c and around the outside yoke.

It is pointed out that the foregoing is satisfactory for boost only; a buck application will saturate the common yoke. Because of the inability to utilize buck-boost, the main core regulating winding is larger. However, the core weight savings is approximately:

$$(0.266)\times(\text{blank length of yoke})\times(\text{height of shortest yoke})\times(\text{yoke width})\text{ pounds,}$$

where the dimensions are specified in inches.

The concept of this invention may be extended with varying degrees of efficiency to the standard shell form transformer (FIG. 5) which embodies separate cores 47, 49, the former of which comprises legs 51, 53 and the latter of which comprises legs 55, 57. Separate windings or coils 58, 61 enclose the legs 53, 55 so as to provide an A phase portion having a common yoke formed by yokes 63, 65 of the cores 47, 49. Likewise, coils 71, 73 around the legs 53, 55 form a B phase having a common yoke formed by yokes 75, 77. Similarly, coils 79, 81 encircling the common legs 53, 55 form a C phase having a common yoke comprised of yokes 83, 85.

In addition to the shell form structure shown in FIG. 5, the concept of this invention is likewise applicable to core form transformers, such as shown in FIG. 6, in which coils 87 are disposed on the legs 89 to cooperate with similar coils 91 on legs 93 of the auxiliary or series portion to form the three phases A, B, and C having a common yoke 95.

Accordingly, the transformer structure of this invention enables the utilization of a common core leg or yoke to reduce the cores size, weight, and loss while eliminating iron. Finally, the concept is useful in single phase as well as three-phase structures.

What is claimed is:

1. A combination main and series transformer having at least one electrical phase, comprising:

a magnetic core having separate main and series winding leg portions, and yoke portions, a main transformer having windings disposed in inductive relation with said main winding leg portions, including a tapped regulating winding arranged only for boost excitation, and a series transformer having windings disposed in inductive relation with said series winding leg portions with the excitation of said series transformer being responsive to said tapped regulating winding, said main winding leg portion having a first yoke and said series winding leg portion having a second yoke, said first and second yokes having different cross-sectional areas, said leg portions of each electrical phase being physically separated from one another by a yoke portion common to both, with the density of the magnetic flux in the main winding leg portion being constant, said magnetic flux flowing only through the main winding leg portion and associated common yoke portion in the absence of series transformer excitation, and additionally flowing through the associated series winding leg portion and common yoke portion as excitation of the series transformer commences, said common yoke portion being equal in cross section to the larger of two yokes which are combined from the main and series transformers.

2. The combination main series transformers of claim 1 wherein the magnetic core is a five-legged, three-phase, shell-form magnetic core, having first, second and third spaced, parallel main winding leg portions, and first, second and third spaced, parallel series winding leg portions, with a single common yoke portion physically separating the first winding leg portions, the second winding leg portions and the third winding leg portions, of the main and series transformers.

3. The combination main and series transformer of claim 1 wherein the magnetic core is a split three-phase, shell-form magnetic core with the main and series windings legs being in alignment, with the main and series winding legs each being formed of a portion of both core halves, and with the main and series winding legs of each phase being physically separated by a yoke portion common to both.

4. The combination main and series transformer of claim 1 wherein the magnetic core is a three-legged, core-form magnetic core, having first, second and third spaced, parallel main winding leg portions, first, second and third spaced, parallel series winding leg portions, with a single common yoke portion physically separating the first winding leg portions, the second winding leg portions, and the third winding leg portions of the main and series transformers.

* * * * *